US009027867B2

(12) United States Patent
Miyamoto

(10) Patent No.: US 9,027,867 B2
(45) Date of Patent: May 12, 2015

(54) SHEET CONVEYANCE UNIT AND IMAGE FORMING APPARATUS INCLUDING SAME

(75) Inventor: Yoshio Miyamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 552 days.

(21) Appl. No.: 13/064,261

(22) Filed: Mar. 15, 2011

(65) Prior Publication Data

US 2011/0240788 A1 Oct. 6, 2011

(30) Foreign Application Priority Data

Mar. 31, 2010 (JP) ..... 2010-082366

(51) Int. Cl.
*B65H 23/16* (2006.01)
*B65H 23/14* (2006.01)
*B65H 23/038* (2006.01)

(52) U.S. Cl.
CPC ..... *B65H 23/14* (2013.01); *B65H 23/16* (2013.01); *B65H 23/038* (2013.01); *B65H 2301/1321* (2013.01); *B65H 2301/331* (2013.01); *B65H 2402/542* (2013.01); *B65H 2403/411* (2013.01); *B65H 2515/815* (2013.01); *B65H 2553/41* (2013.01); *B65H 2553/51* (2013.01); *B65H 2801/12* (2013.01)

(58) Field of Classification Search
CPC .... B65H 23/04; B65H 23/044; B65H 23/046; B65H 3/048; B65H 23/10; B65H 23/16; B65H 23/18; B65H 23/28
USPC ..... 242/419.1, 419, 419.3, 419.4, 419.6, 242/421.8, 423, 423.1, 598.4; 226/15, 16
See application file for complete search history.

(56) References Cited

U.S. PATENT DOCUMENTS 2,250,677 A * 7/1941 Paulsen ..... 101/228
2,637,505 A * 5/1953 Laycock ..... 242/421.9
2,925,270 A * 2/1960 Hollis ..... 226/42
3,114,491 A * 12/1963 Wright ..... 226/75

(Continued)

FOREIGN PATENT DOCUMENTS

JP 59-190151 A 10/1984
JP 03-268974 A 11/1991

(Continued)

OTHER PUBLICATIONS

Japanese Office Action dated Feb. 4, 2014 for corresponding Japanese Application No. 2010-082366.

*Primary Examiner* — Sang Kim
*Assistant Examiner* — Justin Stefanon
(74) *Attorney, Agent, or Firm* — Harness, Dickey & Pierce, P.L.C.

(57) ABSTRACT

A sheet conveyance unit for transporting a sheet unreeled from a roll of paper includes a roll holder including a pair of supporters to support both axial end portions of the roll, movable in an axial direction of the roll, a pair of first conveyance rollers, a pair of second conveyance rollers, a tensioner to tension the sheet, disposed between the first conveyance rollers and the second conveyance rollers, and a tension adjustment unit. The tensioner includes a contact plate to press against the sheet, extending over an entire width of the sheet and pivotably supported on a casing of the sheet conveyance unit. The tension adjustment unit changes the tension of the sheet by adjusting a force to press the contact plate against the sheet and includes a first adjuster to change the tension of the sheet in conjunction with the interval between the supporters.

17 Claims, 9 Drawing Sheets

(56) References Cited

U.S. PATENT DOCUMENTS

| | | | | | |
|---|---|---|---|---|---|
| 3,119,535 | A * | 1/1964 | Hoffman | 226/23 |
| 3,407,981 | A * | 10/1968 | Staugaard | 226/171 |
| 3,512,691 | A * | 5/1970 | Moroz Pavel et al. | 226/23 |
| 3,545,694 | A * | 12/1970 | Kurt | 242/413.8 |
| 3,934,837 | A * | 1/1976 | Keilhack et al. | 242/413.1 |
| 4,546,908 | A * | 10/1985 | Cassese et al. | 226/74 |
| 4,550,623 | A * | 11/1985 | Gysling | 74/89.2 |
| 5,019,864 | A * | 5/1991 | Blanding | 399/165 |
| 5,397,043 | A * | 3/1995 | Blanding | 226/21 |
| 5,497,183 | A * | 3/1996 | Yoshida et al. | 347/215 |
| 5,609,241 | A * | 3/1997 | Shaw | 198/806 |
| 5,774,777 | A * | 6/1998 | Ohtsuka et al. | 399/384 |
| 6,305,857 | B1 * | 10/2001 | Crowley et al. | 400/579 |
| 6,601,951 | B2 * | 8/2003 | Kuwabara et al. | 347/101 |
| 6,799,507 | B2 * | 10/2004 | Ohba et al. | 101/228 |
| 7,124,798 | B2 * | 10/2006 | Wild et al. | 156/538 |
| 2009/0266926 | A1 | 10/2009 | Yoshimaru et al. | |
| 2010/0327515 | A1 | 12/2010 | Nakada et al. | |
| 2011/0063391 | A1 | 3/2011 | Miyamoto et al. | |

FOREIGN PATENT DOCUMENTS

| | | | |
|---|---|---|---|
| JP | 06-211398 | A | 8/1994 |
| JP | 11-246092 | A | 9/1999 |
| JP | 2000238942 | A | 9/2000 |
| JP | 2004182457 | A | 7/2004 |
| JP | 2004299120 | A | 10/2004 |
| JP | 2006248722 | A | 9/2006 |
| JP | 2007055791 | A | 3/2007 |
| JP | 2008-273694 | A | 11/2008 |
| JP | 2009256061 | A | 11/2009 |
| JP | 2010052931 | A | 3/2010 |

* cited by examiner

SHEET CONVEYANCE UNIT AND IMAGE FORMING APPARATUS INCLUDING SAME

CROSS-REFERENCE TO RELATED APPLICATIONS

This patent specification is based on and claims priority from Japanese Patent Application No. 2010-082366, filed on Mar. 31, 2010 in the Japan Patent Office, which is hereby incorporated by reference herein in its entirety.

BACKGROUND OF THE INVENTION

1. Field of the Invention

The present invention generally relates to a sheet conveyance unit used in an image forming apparatus, such as a copier, a printer, a facsimile machine, or a multifunction machine including at least two of these functions, and an image forming apparatus including the sheet conveyance unit.

2. Discussion of the Background Art

There are image forming apparatuses that form images on a single continuous long sheet of paper unreeled from a paper roll, transported by a sheet conveyance unit that typically includes a paper roll holder to support the paper roll and keep the sheet unreeled from the paper roll taut to transport the sheet reliably.

For example, JP-H11-246092-A and JP-S59-190151-A propose sheet conveyance units that include a tension guide provided with multiple elastic protrusions arranged like the teeth of a comb. The tension guide extends in a sheet width direction, perpendicular to a direction in which the long sheet is transported. Among the multiple elastic protrusions, those positioned in an area corresponding to the width of the sheet are pressed against the sheet, thus exerting a force to keep the sheet taut over the width of the sheet.

This approach, however, has several drawbacks. For example, because the protrusions are elastic, the force to keep the sheet taut exerted by each protrusion tends to fluctuate, skewing the sheet. Although JP-S59-190151-A states that the tension guide holds both ends of the sheet in the sheet width direction, thereby restricting the skew of the sheet, it is difficult to arrange the multiple elastic protrusions to accommodate all sheet sizes when the sheet conveyance unit accommodates domestic sheet sizes as well as foreign sheet sizes. More specifically, to accommodate both a domestic sheet size and a similar foreign sheet size, the elastic protrusions inevitably become very thin. Moreover, it is possible that the sheet is damaged or marked by the tooth-like protrusions pressed against the sheet.

SUMMARY OF THE INVENTION

In view of the foregoing, one illustrative embodiment of the present invention provides a sheet conveyance unit for transporting a sheet unreeled from a roll. The sheet conveyance unit includes a casing, a roll holder including a pair of supporters to support both axial end portions of the roll, a pair of first conveyance rollers to clamp the sheet unreeled from the roll therebetween and to transport the sheet, a pair of second conveyance rollers disposed downstream from the pair of first conveyance rollers in a sheet conveyance direction, to clamp therebetween the sheet transported from the pair of first conveyance rollers and to transport the sheet, a tensioner to tension the sheet, disposed between the pair of first conveyance rollers and the pair of second conveyance rollers, and a tension adjustment unit connected to the pair of supporters of the roll holder, to adjust the tension of the sheet. The pair of supporters are movable in an axial direction of the roll with an interval between the supporters varied. The tensioner includes a contact plate extending over an entire width of the sheet and having a first face to press against the sheet. The contact plate is pivotably supported on the casing of the sheet conveyance unit. The tension adjustment unit change a force to press the contact plate against the sheet to adjusts the tension of the sheet. The tension adjustment unit includes a first adjuster to change the tension of the sheet in conjunction with the supporters of the roll holder, in accordance with the interval between the supporters.

Another illustrative embodiment of the present invention provides an image forming apparatus that includes an image forming unit and the sheet conveyance unit described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
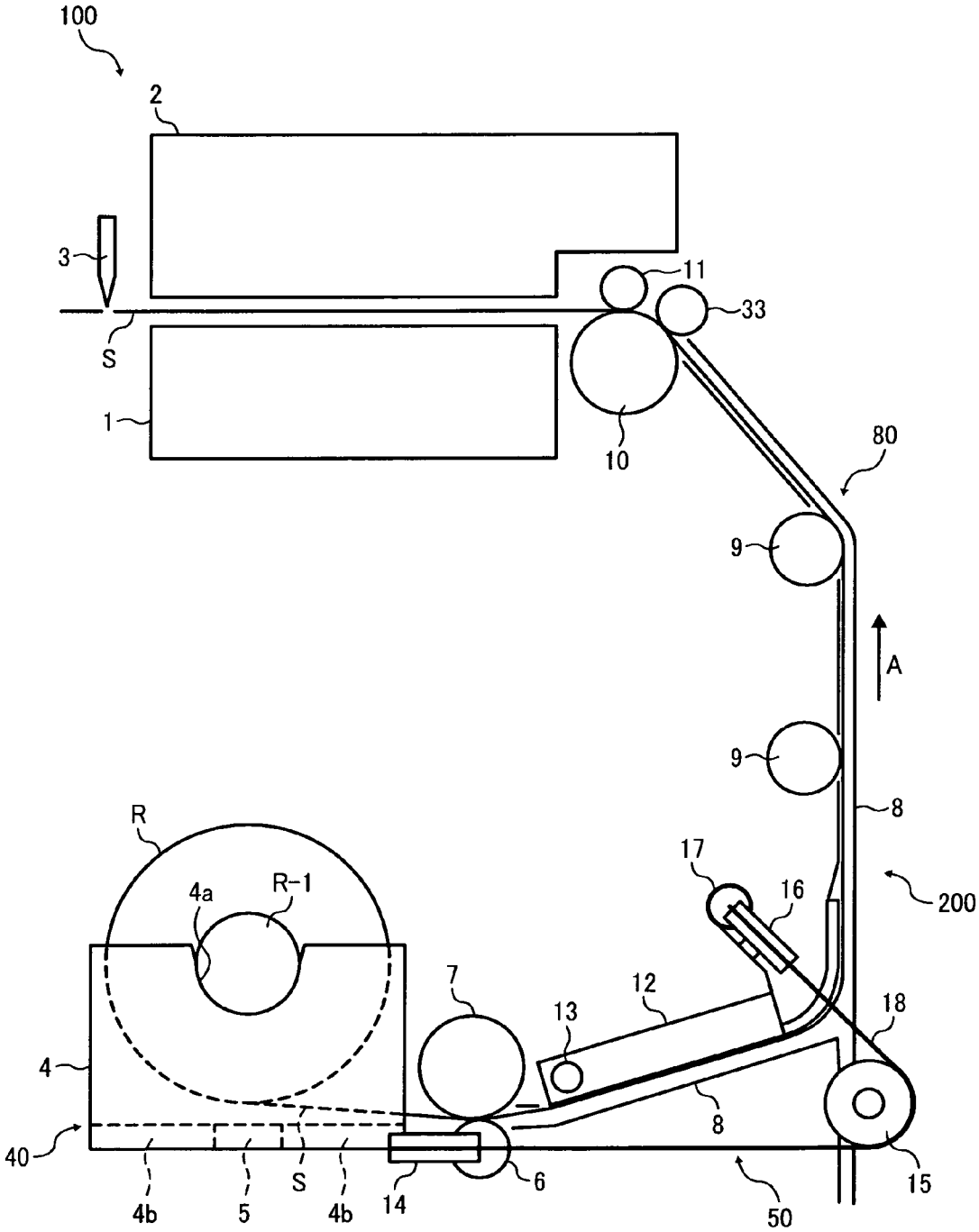
FIG. 1 is a schematic vertical side view of an image forming apparatus according to an illustrative embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus according to an illustrative embodiment of the present invention is described.

First Embodiment

FIG. 1 is a schematic side view of an image forming apparatus according to a first embodiment.

As shown in FIG. 1, a sheet conveyance unit 200 is incorporated in an image forming apparatus in the present embodiment. The image forming apparatus includes a printing device 100, a paper roll holder 40 for supporting a paper roll R in which a long sheet S winds around a shaft R−1, a pair of feed rollers 6 and 7 serving as a first conveyance member, a guide unit 80 for guiding the long sheet S unreeled from the paper roll R, a pair of registration rollers 10 and 11 serving as a second conveyance member, a pressure member 12 serving as a tensioner, a tension adjustment unit 50, and a clamping force adjustment unit 60. The guide unit 80 includes multiple sheet guides 8 and relay rollers 9. The above-described components except the printing device 100 together form the sheet conveyance unit 200.

The printing device 100 includes a suction stay 1, a carriage 2 that is movable in a main scanning direction, that is, a sheet width direction, and a cutter 3. The suction stay 1 sucks in the long sheet S unreeled from the paper roller R and fed by the sheet conveyance unit 200 in a direction indicated by arrow A shown in FIG. 1 (hereinafter "sheet conveyance direction"), thereby keeping it flat. The carriage 2 performs printing, that is, form images such as letters, illustrations, and the like, on the sheet S while the suction stay 1 sucks in the sheet S. The cutter 3 cuts the long sheet S into a predetermined or desirable size after the image is formed on that portion. It is to be noted that, after the cutter 3 cuts off the portion on which the image is formed, a leading edge portion of the sheet S unreeled from the paper roll R is returned to a printing start position by the sheet conveyance unit 3.

Figure 2:
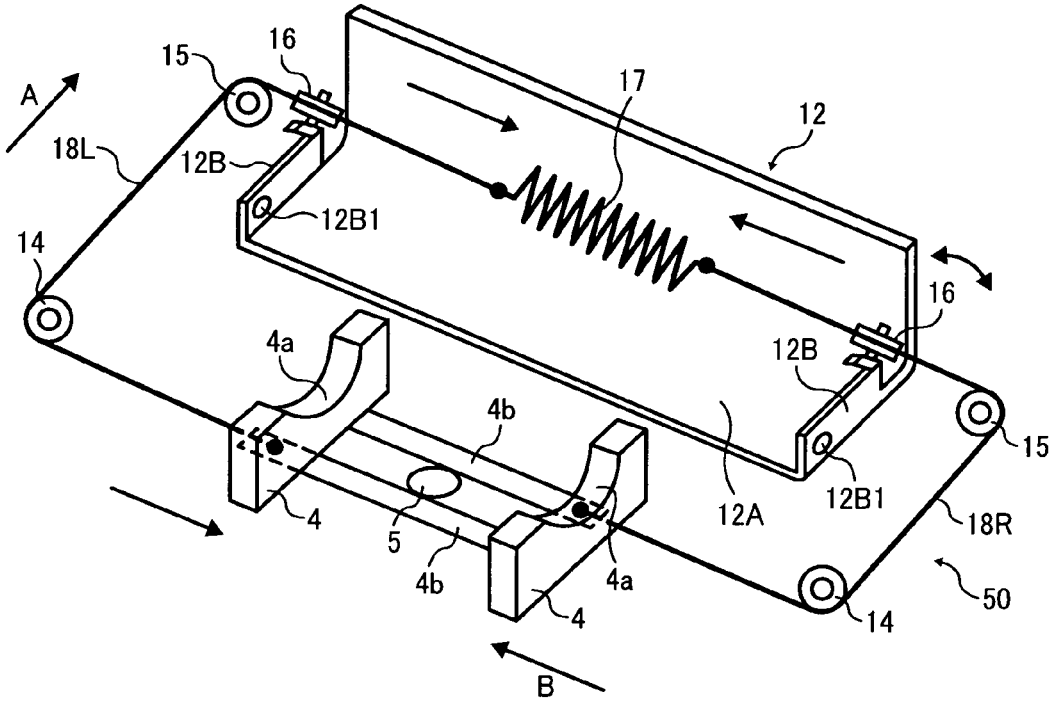
FIG. 2 is a perspective view that illustrates a paper roll rack of a sheet conveyance unit according to an illustrative embodiment in a state in which the paper roll rack is contracted.
Figure 3:
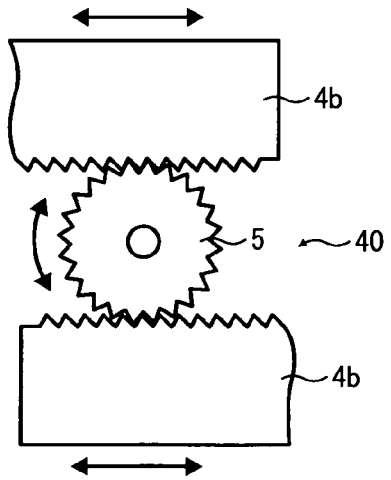
FIG. 3 is an enlarged plan view that schematically illustrates a rack-and-pinion mechanism of the paper roll holder.

FIG. 2 is a perspective view that illustrates a paper roll rack 4 of the sheet conveyance unit 200 in a state in which the paper roll rack 4 is contracted. FIG. 3 is an enlarged plan view that schematically illustrates a rack-and-pinion mechanism of the paper roll holder 40.

In FIG. 2, reference character B represents the sheet width direction. In the description below, the terms "upstream" and "downstream" mean those in the sheet conveyance direction unless otherwise specified. As shown in FIGS. 1 and 2, the paper roller holder 40 includes a pair of slidable planar supporters 4, a pair of parallel racks 4*b* extending in the sheet width direction indicated by arrow B, perpendicular to the direction in which the pair of planar supporters 4 extends, and a rotatable pinion gear 5. A semicircular recess 4*a* is formed in an upper portion of each supporter 4, in a center portion in the sheet conveyance direction indicated by arrow A. The racks 4*b* are connected to the bottoms of the pair of planar supporters 4 and positioned with their rack teeth facing each other. The supporters 4 are slidable. The teeth of the racks 4*b* engage the pinion gear 5. Both axial end portions of the shaft R−1 of the paper roll R are supported by the recesses 4*a* of the supporters 4, respectively.

With this configuration, when one of the supporters 4 is moved toward or away from the other supporter 4, the other supporter 4 moves in conjunction with it via the racks 4*b* and the pinion gear 5. Thus, the interval between the supporters 4 is adjustable in accordance with the sheet width, that is, the length between the axial end portions of the shaft R−1 of the paper roller R in which the long sheet. S is rolled. The interval between the supporters 4 is changed for each sheet width. Therefore, a scale including multiple sheet width marks is provided in a fixed portion of the sheet conveyance unit 200, and the supporters 4 are set according to the sheet width marks in the scale. Thus, the interval between the supporters 4 can be adjusted to conform to the sheet width. It is to be noted that, alternatively, the sheet conveyance unit 200 may further includes a motor to rotate the pinion gear 5, and the motor may rotate the pinion gear 5 according to the sheet width, thereby adjusting the interval between the supporters 4.

Additionally, the paper roll holder 4 further includes a lock mechanism to lock the supporters 4 at given positions. When the interval between the supporters 4 is changed, the lock is released, after which the supporters 4 are moved. The supporters 4 are locked again after the interval therebetween are adjusted.

The pair of feed rollers 6 and 7, serving as the first conveyance member, is rotatable, driven by a motor. The feed rollers 6 and 7 press against each other and are provided on the side of the paper roll holder 40 as shown in FIG. 1. The pair of feed rollers 6 and 7 serving as the first conveyance member clamps therebetween the sheet S unreeled from the paper roll R supported by the paper roll holder 40 and sends out the sheet S laterally.

The feed roller 6 that forms the lower side of the first conveyance member is supported by the clamping force adjustment unit 60 so that the sheet clamping force of the feed rollers 6 and 7, that is, the force with which the feed roller 6 presses against the upper feed roller 7 is adjustable in accordance with the interval between the supporters 4. The operation of the clamping force adjustment unit 60 is described in further detail later.

The guide unit 80 including the multiple sheet guides 8 and the relay rollers 9 is positioned downstream from the feed rollers 6 and 7. As shown in FIG. 1, each of the multiples sheet guides 8 is bent into a lateral U-like shape having two corners and forms the sheet conveyance path through which the sheet S fed by the feed rollers 6 and 7 is conveyed to the pair of registration rollers 10 and 11. The multiple sheet guides 8 change the direction of the sheet S transported laterally by the feed rollers 6 and 7 twice in the configuration shown in FIG. 1. More specifically, the multiple sheet guides 8 guide the sheet S, which is sent out laterally, upward and then guides it to the upper left in FIG. 1. The relay rollers 9 are provided rotatably at the upper corner of the sheet conveyance path formed by the sheet guides 8 and in a center portion of the vertically extending portion of the sheet conveyance path, respectively.

As shown in FIG. 1, the registration rollers 10 and 11, together forming the second conveyance member, press against each other and positioned at an exit of the guide unit 80. The sheet S winds around the lower registration roller 10 partly, and the lower registration roller 10 forwards the sheet S to the printing device 100 at a predetermined timing, rotated by a motor. It is to be noted that, when the registration rollers 10 and 11 are on standby and does not transport the sheet S, the feed rollers 6 and 7 are also on standby.

As shown in FIGS. 1 and 2, the pressure member 12, serving as the tensioner, includes an L-shaped plate 12A that has a width greater than the width of the sheet S and is bent into an L shape when viewed from a side. The plate 12A includes a lower portion or a bottom portion and an upper portion extending upward from the lower portion. The pressure member 12 further includes side walls 12B standing from both ends in the sheet width direction of the lower portion of the L-shaped plate 12A. Each side wall 12B extends in the sheet conveyance direction indicated by arrow A except a corner portion between the lower portion and the upper portion of the L-shaped plate 12A. The pressure member 12 is disposed facing the multiple sheet guides 8, together forming the sheet conveyance path. Accordingly, the pressure member 12 also serves as a guide for guiding the sheet S. The corner portion of the L-shaped plate 12A is positioned at the lower corners of the multiple sheet guides 8 forming the sheet conveyance path. A hole 12B1 is formed in an end portion of each side wall 12B opposite the corner portion of the L-shaped plate 12A, and a support shaft 13, shown in FIG. 1, that projects from a frame of the sheet conveyance unit 200 engages the hole 12B1 of each side wall 12B. Thus, the pressure member 12 can pivot about the support shafts 13.

In other words, the pressure member 12 serving as the tensioner is pivotable with an outer face of the bottom portion (lower portion) of the L-shaped plate 12A in contact with the sheet S over the entire width in a portion between the pair of feed rollers 6 and 7 (i.e., first conveyance member) and the pair of registration rollers 10 and 11 (i.e., second conveyance member). The pressure member 12 presses against the sheet S to keep the sheet S taut with a pressing force adjustable by the tension adjustment unit 50. The tension adjustment unit 50 includes a first adjuster to adjust the tension of the sheet S in conjunction with changes in the interval between the supporters 4.

As shown in FIGS. 1 and 2, the tension adjustment unit 50 includes a pair of pulleys 14, a pair of pulleys 15, a pair of pulleys 16, rotatably connected to the end portions of the side walls 12B, opposite to the corner of the L-shaped pressure member 12, inside the pair of pulleys 15 in the sheet width direction, a first tension spring 17, and right and left wires 18R and 18L. The pulleys 14 or 15 serve as first pulleys, and the first tension spring 17, the pulleys 14 and 15, and the wires 18R and 18L together form the first adjuster. The pair of pulleys 14 is provided rotatably outside the pair of supporters 4 in the sheet width direction, beneath the pressure member 12. The pair of pulleys 15 is provided rotatably outside the corner of the L-shaped pressure member 12 in the sheet width direction, beneath the pressure member 12. That is, the positions of the first and second pairs of the pulleys 14 and 15 are the same as or similar to the positions of the supporters 4 and the corner of the pressure member 12, respectively. The first tension spring 17 is positioned on the upper left of the corner of the pressure member 12 in FIG. 1 and in a center portion of the pressure member 12 in the sheet width direction. The first pair of wires 18R and 18L is stretched so as to connect both ends of the first tension spring 17 to the parallel racks 4*b* via the pairs of pulleys 14, 15, and 16. Hereinafter the right and left wires 18R and 18L may be also referred to as a first pair of wires 18.

In the configuration shown in FIG. 2, the left wire 18L connects the left end of the first tension spring 17 to the left end portion of the rack 4*b* attached to the right supporter 4, opposite the left end of the first tension spring 17. Similarly, the right wire 18R connects the right end of the first tension spring 17 to the right end portion of the rack 4*b* attached to the left supporter 4, facing the right supporter 4 on the same side as the right end of the first tension spring 17.

In the tension adjustment unit 50 configured as described above, when the pressure member 12 is caused to pivot upward with the supporters 4 fixed in position, the first tension spring 17 is extended via the first pair of wires 18, generating a force to pull the pair of first wires 18. Because the pair of pulleys 16 connected to the end portions of the side walls 12B is positioned above the pair of pulleys 15, a force to push down the pressure member 12 is exerted on the pressure member 12.

As shown in FIG. 2, when the interval between the supporters 4 is reduced, the first tension spring 17 is retracted, and accordingly the force of the pressure member 12 pressing the sheet S is reduced. Consequently, the tension of the sheet S in contact with the lower face of the pressure member 12 is reduced.

Figure 4:
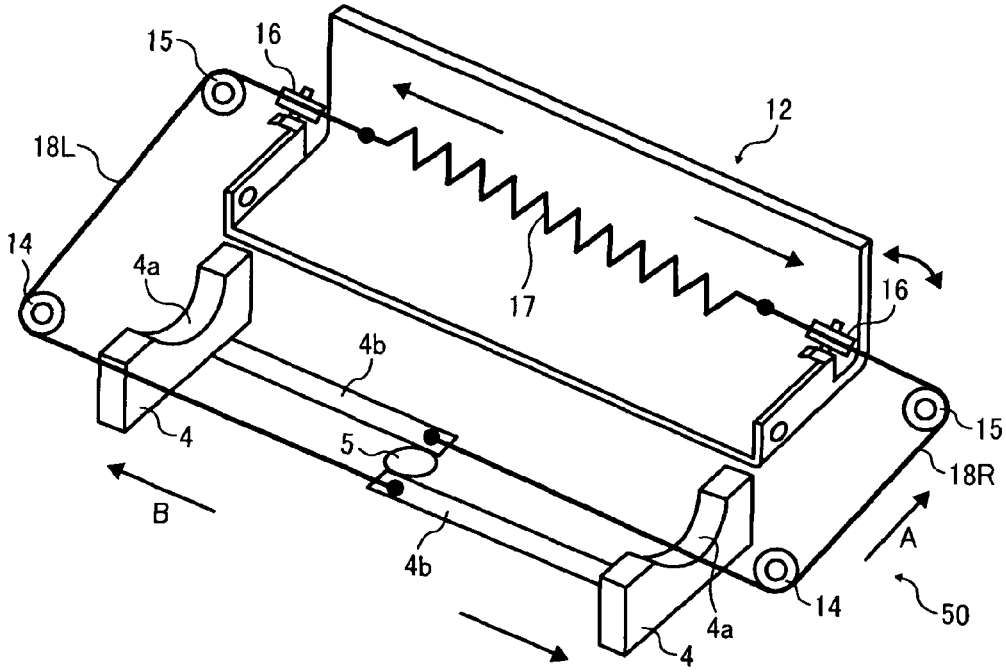
FIG. 4 is a perspective view that illustrates the paper roll rack of the sheet conveyance unit in a state in which the paper roll rack is extended.

By contrast, as shown in FIG. 4, when the interval between the supporters 4 is increased, the first tension spring 17 is extended, and accordingly the force of the pressure member 12 pressing the sheet S is increased. Consequently, the tension of the sheet S in contact with the lower face of the pressure member 12 is increased.

Figure 5:
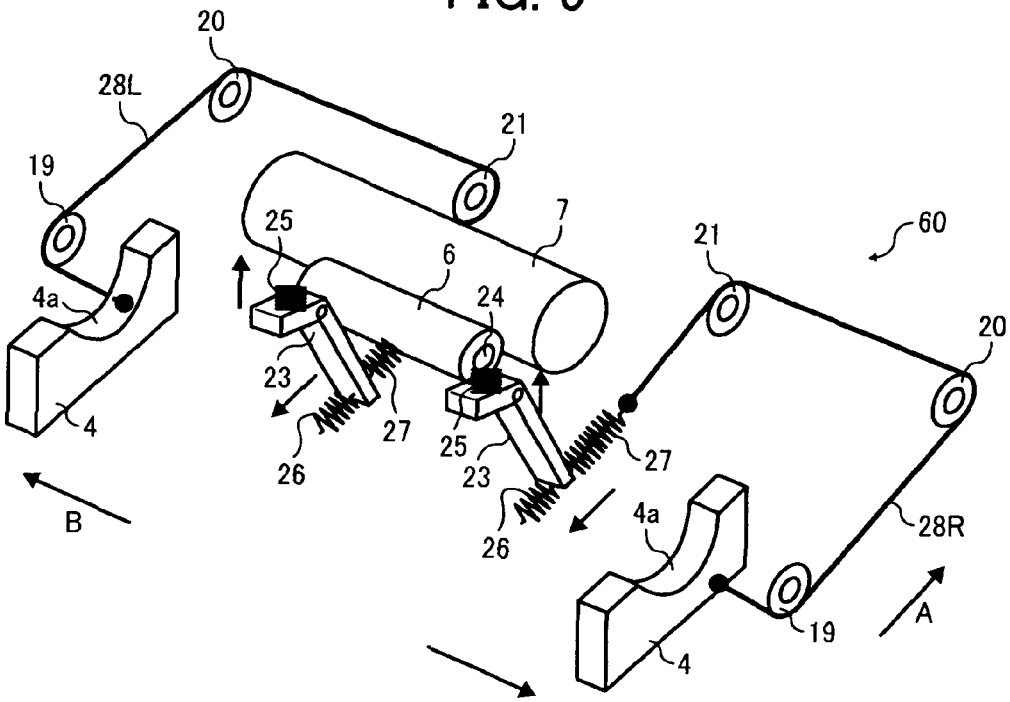
FIG. 5 is a perspective view of the sheet conveyance unit and illustrates the relation between a clamping force adjustment unit and the paper roll rack.
Figure 6:
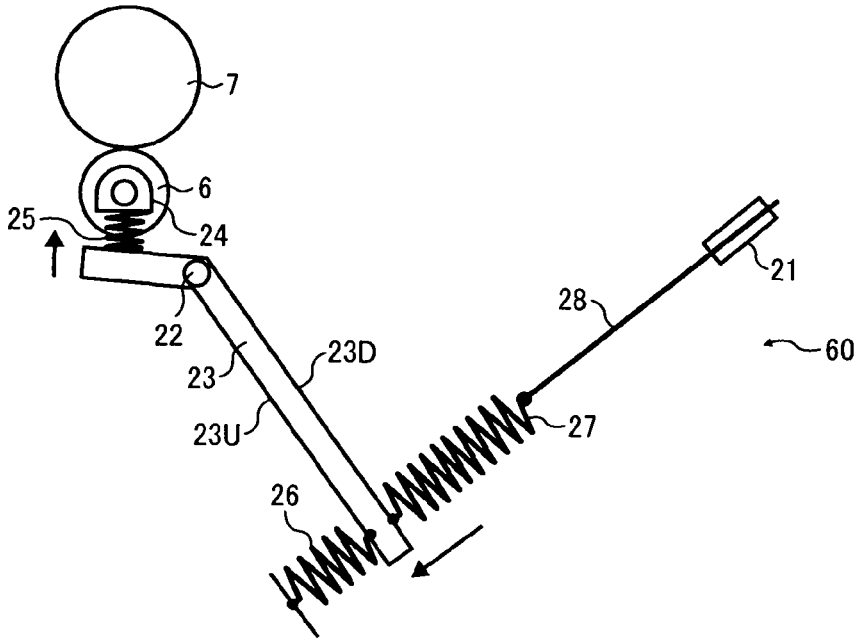
FIG. 6 is a partial enlarged side view of a clamping force adjustment unit.

FIG. 5 is a perspective view of the sheet conveyance unit 200 and illustrates the relation between the clamping force adjustment unit 60 and the supporters 4. FIG. 6 is a partial enlarged view of the clamping force adjustment unit 60.

As shown in FIGS. 5 and 6, the clamping force adjustment unit 60 includes a pair of pulleys 19 provided rotatably outside the pair of supporters 4 in the sheet width direction indicated by arrow B, a pair of pulleys 20 provided rotatably downstream from the pair of pulleys 19 in the sheet conveyance direction indicated by arrow A, a pair of pulleys 21 provided rotatably inside the pair of pulleys 20 in the sheet width direction, a pair of support arms 23 each of which is shaped like L placed upside down, a pair of bearings 24 that supports both end portions of the lower feed roller 6 rotatably, a pair of compression springs 25 each of which connected to the bearing 24 and an upper portion of the support arm 23, a second pair of tension springs 26, a third pair of tension springs 27, and right and left wires 28R and 28L (a second pair of wires 28). A support shaft projecting from the frame of the sheet conveyance unit 200 is inserted into a bent portion of the support arm 23. Thus, each support arm 23 is pivotable beneath the end portion of the feed roller 6 and about a support shaft 22 in the sheet conveyance direction indicated by arrow A.

One end of each tension spring 26 is connected to a downstream side 23D of a lower portion of the support arm 23, and the other end is connected to the frame of the sheet conveyance unit 200. One end of each tension spring 27 is connected to an upstream side 23U of the lower portion of the support arm 23, and the other end is connected to the second wire 28. The upstream side 23D of the support arm 23 is on the side of the supporter 4, and the downstream side 23U thereof is on the opposite side to the supporter 4. The second wire 28R connected to the third tension spring 27 on the right is stretched around the pairs of pulleys 19, 20, and 21 on the right and is further connected to the right supporter 4 in FIG. 5. Similarly, the second wire 28L connected to the third tension spring 27 on the left is stretched around the pulleys 19, 20, and 21 on the left and is further connected to the left supporter 4 in FIG. 5.

Figure 7:
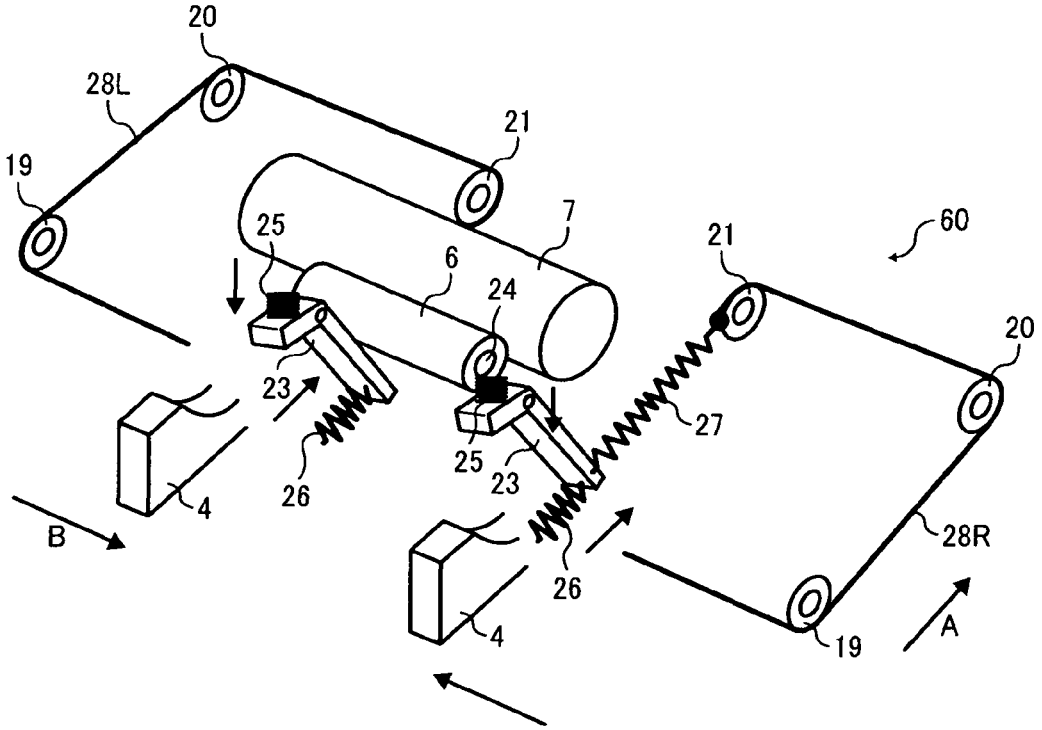
FIG. 7 is a perspective view of the sheet conveyance unit and illustrates the relation between the clamping force adjustment unit and the paper roll rack.
Figure 8:
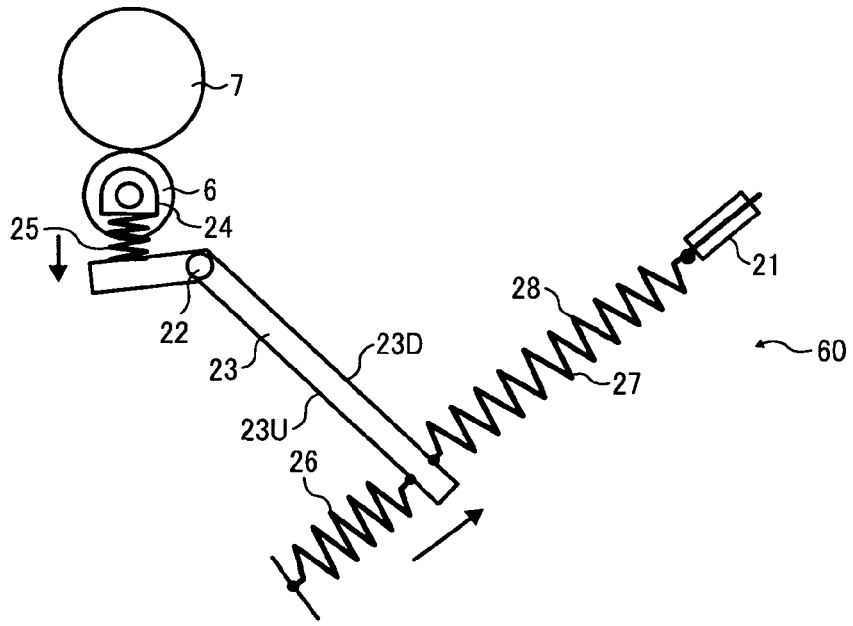
FIG. 8 is a partial enlarged side view of the clamping force adjustment unit.

FIG. 7 is a perspective view of the sheet conveyance unit 200 and illustrates the relation between the clamping force adjustment unit 60 and the supporters 4. FIG. 8 is a partial enlarged view of the clamping force adjustment unit 60.

With the clamping force adjustment unit 60 configured as described above, as shown in FIGS. 7 and 8, when the interval between the pair of supporters 4 is reduced, the second wires 28 pull the respective support arms 23 in the sheet conveyance direction indicated by arrow A. Accordingly, each support arm 23 pivots about the support shaft 22 so that its upper portion, extending upstream from the support shaft 22, descends. Then, the compression springs 25 are stretched, thus reducing the pressure to the lower feed roller 6 that is supported by the bearings 24 to which the respective compression springs 25 are attached. Accordingly, the pressure to the feed roller 7 above the lower feed roller 6 is reduced. As a result, the sheet clamping force exerted by the feed rollers 6 and 7 is reduced.

By contrast, as shown in FIGS. 5 and 6, when the interval between the pair of supporters 4 is increased, the second tension springs 26 pull the respective support arms 23. Accordingly, each support arm 23 pivots about the support shaft 22 so that its upper portion ascends. Then, the compression springs 25 retract, thus increasing the pressure to the lower feed roller 6 via the bearings 24 to which the respective compression springs 25 are attached. Accordingly, the pressure to the feed roller 7 above the lower feed roller 6 is increased. As a result, the sheet clamping force exerted by the feed rollers 6 and 7 increases.

Thus, the clamping force adjustment unit 60 changes the sheet clamping force exerted by the pair of feed rollers 6 and 7 serving as the first conveyance member in conjunction with changes in the interval between the supporters 4. The clamping force adjustment unit 60 increases the clamping force as the interval between the supporters 4 increases and decreases the clamping force as the interval between the supporters 4 is reduced.

Next, actions and effects of the image forming apparatus according to the first embodiment are described below.

Initially, either supporter 4 is moved to adjust the interval between the supporters 4 according to the axial length of the paper roller R of given sheet size.

Then, the both axial end portions of the shaft R−1 of the paper roller R are mounted on the recesses 4*a* of the supporters 4, and thus the paper roller R is supported by the supporters 4. The paper roller R is mounted on the supporters 4 so that the sheet S is fed from the bottom of the paper roller R to the feed rollers 6 and 7.

Subsequently, the leading edge portion of the sheet S is inserted between the feed rollers 6 and 7, and then sheet feeding by the feed rollers 6 and 7 is started. For example, sheet feeding may be triggered when a user presses a sheet feeding button provided in an operation panel of the image forming apparatus or in conjunction with closing or opening of a cover of the image forming apparatus. The trigger of sheet feeding, however, is not limited thereto.

Thus, the feeding rollers 6 and 7 start rotating with the sheet clamped therebetween, thereby feeding the sheet S, after which or simultaneously, the registration rollers 10 and 11 start rotating. When the leading edge portion of the sheet S is inserted between the registration rollers 10 and 11, conveyance of the sheet S is halted. Then, the registration rollers 10 and 11 restart rotating so that sheet conveyance is timed to coincide with printing by the printing device 100.

Then, the suction stay 1 starts sucking in the sheet S, and the carriage 2 executes printing on the sheet S. After printing is completed, the sheet S is transported by a required distance, and then the cutter 3 cuts the sheet S into a given length. Then, conveyance rollers including the registration rollers 10 and 11 are rotated in reverse to return the sheet S to the printing start position for subsequent printing. Above-described feeding and returning the sheet S are repeated for each printing job.

While the sheet S is transported, the portion of the sheet S positioned between the feed rollers 6 and 7 and the registration rollers 10 and 11 exerts a force on pressure member 12, that is, causes the pressure member 12 to swing upward. The first tension spring 17 is extended via the wires 18, thereby pulling the wires 18. Accordingly, the wires 18 exert the force pushing down the pressure member 12. Consequently, the portion of the sheet S positioned between the feed rollers 6 and 7 and the registration rollers 10 and 11 is tensioned with a predetermined or desired force.

When the interval between the supporters 4 is reduced to fit a paper roll R of smaller sheet width, as described above, the first tension spring 17 is retracted and the force of the pressure member 12 pressing the sheet S is reduced. Consequently, the tension of the sheet S in contact with the lower face of the pressure member 12 is reduced. By contrast, when the interval between the supporters 4 is increased to fit a paper roll R of greater sheet width, the first tension spring 17 is extended and the force of the pressure member 12 pressing the sheet S is increased. Consequently, the tension of the sheet S in contact with the lower face of the pressure member 12 is increased. Thus, the tension of the sheet S can be adjusted to a suitable degree in accordance with sheet width.

Additionally, although possibility of slippage of the sheet S between the feed rollers 6 and 7 increases when the width of the sheet S is greater because the sheet S of greater width is heavier than the sheet S of smaller width, slippage of the sheet S can be restricted as follows. Increasing the interval between the supporters 4 to fit the sheet S of greater width causes the second tension springs 26 to pull the respective support arms 23, and thus each support arm 23 pivots about the support shaft 22 with its upper portion ascending. Then, the compression springs 25 retract, thus increasing the pressure that is exerted on the feed roller 7 positioned above the lower feed roller 6 via the bearings 24. As a result, the sheet clamping force exerted by the feed rollers 6 and 7 increases, which can restrict slippage of the sheet S and secure reliable conveyance of the sheet S.

It is to be noted that, although, in the above-described configuration, only the sheet clamping force by the feed rollers 6 and 7 is adjustable in conjunction with changes in the interval between the supporters 4, alternatively, the sheet clamping force exerted by the registration rollers 10 and 11 may be adjusted by a similar mechanism. Yet alternatively, both the sheet clamping force by the feed rollers 6 and 7 and that by the registration rollers 10 and 11 may be adjusted.

Figure 9:
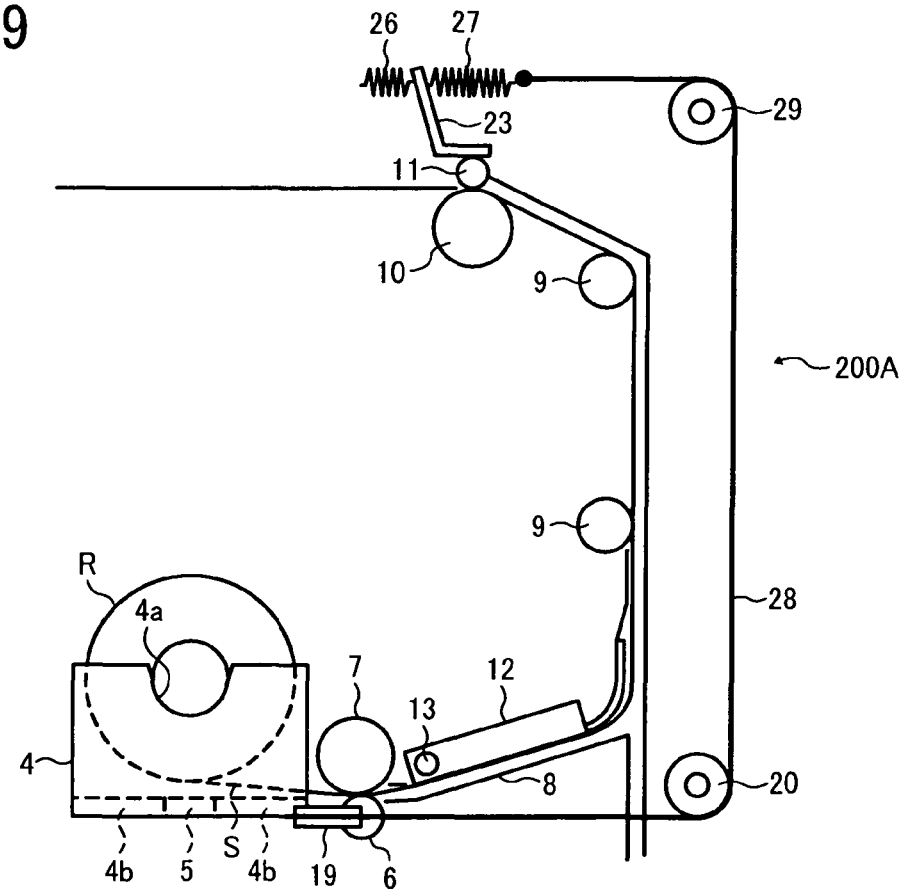
FIG. 9 is a schematic vertical side view of another configuration of the clamping force adjustment unit.

FIG. 9 illustrates a sheet conveyance unit 200A according to a variation of the first embodiment, and the sheet clamping force by the registration rollers 10 and 11 is adjustable in the sheet conveyance unit 200A.

As shown in FIG. 9, bearings of the upper registration roller 11 are fixed to the respective support arms 23, and the power point side of each support arm 23 is connected to the second tension spring 26 and the third tension spring 27. The third tension spring 27 is connected to the supporter 4 via the second wire 28 or another wire that is stretched around the pulleys 19 and 20 as well as a pulley 29.

It is preferable to increase the sheet clamping force by the registration rollers 10 and 11 when the width of the sheet S is smaller for preventing or reducing slippage of the sheet S. Therefore, each of the second wires 28, namely, the right and left wires 28R and 28L, is connected to the supporter 4 on the opposite side similarly to those in the tension adjustment unit 50 shown in FIG. 2.

As described above, in the image forming apparatus according to the first embodiment, the portion of the sheet S positioned between the feed rollers 6 and 7 and the registration rollers 10 and 11 is pressed against the pressure member 12 partly in the sheet conveyance direction but fully in the sheet width direction, and thus the sheet S is tensioned. Additionally, the tension adjustment unit 50 adjusts the pressing force exerted by the pressure member 12 in accordance with changes in the interval between the supporters 4. With this configuration, the force in accordance with the size of the sheet S can be exerted on the sheet S uniformly, thus eliminating or reducing unevenness in the elastic force (pressing force) exerted on the sheet S, which is caused in a configuration in which a pressing members shaped like tooth of a comb exerts the force to keep the sheet taut. Consequently, sheets of any size (any width) can be inhibited from being skewed. Because the pressing force exerted by the pressure member 12 to press against the sheet S is adjusted in conjunction with changes in the interval between the supporters 4 of the paper roll holder 40, adjustment of the tension of the sheet S can be simplified and prompt.

Moreover, the pressure member 12 presses against the sheet S over the entire width. In other words, the sheet S is pressed against not points but a surface of the pressure member 12, and accordingly the pressing force is not localized but can be distributed uniformly. Therefore, pressed marks on the sheet S can be eliminated.

Second Embodiment

A second embodiment is described below.

An image forming apparatus according to the second embodiment includes a skew detector 30 to detect skew of the sheet S and a slippage detector to detect slippage of the sheet S in addition to the configuration according to the first embodiment, and the tension adjustment unit 50 can adjust the pressing force according to detection results generated by the skew detector 30 and the slippage detector. More specifically, the tension adjustment unit 50 further includes a second adjuster to adjust the tension of the sheet S regardless of changes in the interval between the supporters 4.

Figure 10:
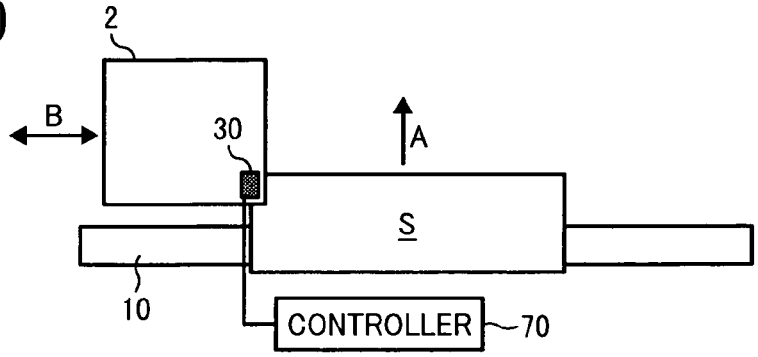
FIG. 10 is an enlarged plan view that illustrates a skew detector.
Figure 11:
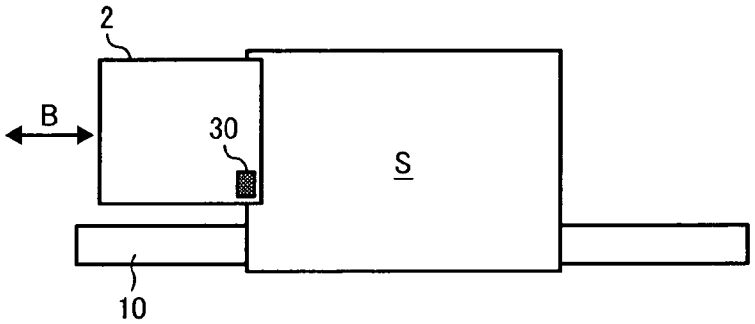
FIG. 11 is an enlarged plan view that illustrates the skew detector.

FIGS. 10 and 11 are enlarged plan views that illustrate the skew detector. The components of the sheet conveyance unit 200A similar to those of the first embodiment are given identical or similar reference characters, and thus descriptions thereof are omitted below.

For example, the skew detector 30 may be a photosensor (hereinafter also "the photosensor 30") and may be attached to the carriage 2 as shown in FIG. 10. The carriage 2 is set at a predetermined position so that one edge of the sheet S in the width direction indicated by arrow B is positioned in a center portion of the photosensor 30. Then, as shown in FIG. 11, the sheet S is transported a predetermined or given distance, and a controller 70 determines whether the sheet S is skewed based on changes in the output from the photosensor 30. It is to be noted that the controller 70 codes outputs from the photosensor 30 and then determines whether the sheet S is skewed based on the code. For example, the controller 70 includes a central processing unit (CPU) and associated memory units (e.g., ROM, RAM, etc.), and performs various types of control processing by executing programs stored in the memory. Field programmable gate arrays (FPGA) may be used instead of CPUs.

Additionally, the skew detector 30 may include two photosensors. In this case, two photosensors are attached to the carriage 2 at a predetermined or given interval in the sub-scanning direction, that is, the sheet conveyance direction indicated by arrow A. The carriage 2 is set at a position where one end of the sheet S in the sheet width direction is positioned between the two photosensors. Then, the sheet S is transported a predetermined or given distance. The controller 70 determines whether the sheet S is skewed based on the outputs from the respective photosensors, that is, based on binary data. More specifically, when the outputs from the photosensors are "0" and "1", the controller 70 determines that the sheet is not skewed. When the outputs from both photosensors are an identical, "0" or "1", the controller 70 determines that the sheet is skewed.

Skew of the sheet S is detected in an initial setting of the sheet S. If the controller 70 determines that the sheet S is skewed, the tension adjustment unit 50 increases the tension of the sheet S. It is to be noted that the initial setting of the sheet S used herein means transporting the sheet S to the predetermined position, such as the printing start position, so that printing can be executed after replacement of paper roll or the apparatus is powered on. Skew of the sheet S is detected and corrected automatically each initial setting of the sheet S in the present embodiment.

Figure 12:
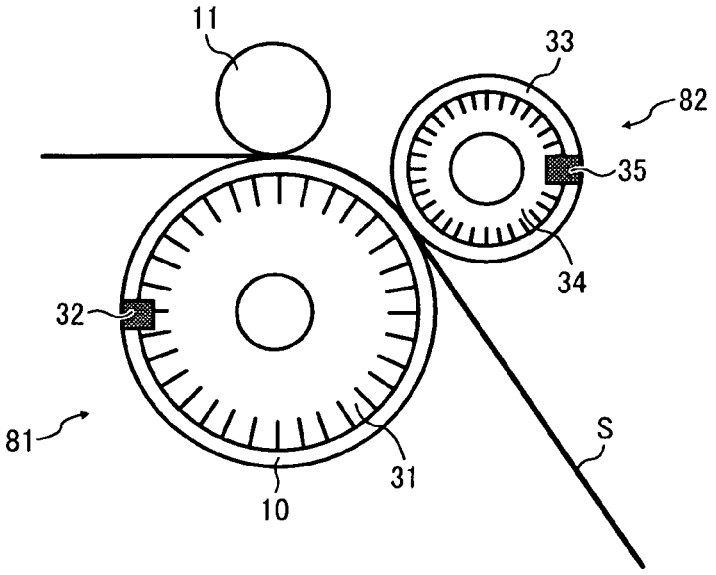
FIG. 12 is an enlarged side view that illustrates a slippage detector.

FIG. 12 is an enlarged side view that illustrates the slippage detector.

As shown in FIG. 12, the slippage detector includes a first rotary encoder 81 and a second rotary encoder unit including a second rotary encoder 82.

The first rotary encoder 81 includes a first slit disc 31 with slits, provided at the shaft of the lower registration roller 10, and a first transmission photosensor 32 to detect the slit of the first slit disc 31. The first slit disc 31 can be rotated by a motor. The first rotary encoder 81 detects the amount by which the sheet S is transported theoretically (theoretical conveyance distance or theoretical conveyance amount) by detecting the amount by which the lower registration roller 10 rotates (rotational amount) in a unit time.

The second rotary encoder unit includes a roller 33 disposed facing the lower registration roller 10 via the sheet S and the second rotary encoder 82. The roller 33 can be driven by conveyance of the sheet S. The second rotary encoder 82 includes a second slit disc 34 with slits, provided at the shaft of the roller 33, and a second transmission photosensor 35 to detect the slit of the second slit disc 34. The second rotary encoder 82 detects the amount by which the sheet S is actually transported (actual conveyance distance or actual conveyance amount) by detecting the amount by which the roller 33 rotates (rotational amount) in a unit time as the sheet S is transported.

The slippage detector compares theoretical conveyance distance of the sheet S per unit time detected by the first rotary encoder 81 with the actual conveyance distance of the sheet S per unit time detected by the second rotary encoder 82, thereby detects slippage of the sheet S. More specifically, although the conveyance amounts detected by the first and second rotary encoders 81 and 82 are identical when the sheet S does not slip, the conveyance amount detected by the second rotary encoder 82 is smaller than that by the first rotary encoder 81 when the sheet S slips. Thus, the slippage detector detects occurrence of slippage of the sheet S. Slippage of the sheet S is detected in an initial setting of the sheet S. If slippage of the sheet S is detected, the tension adjustment unit 50 reduces the tension of the sheet S.

Figure 13:
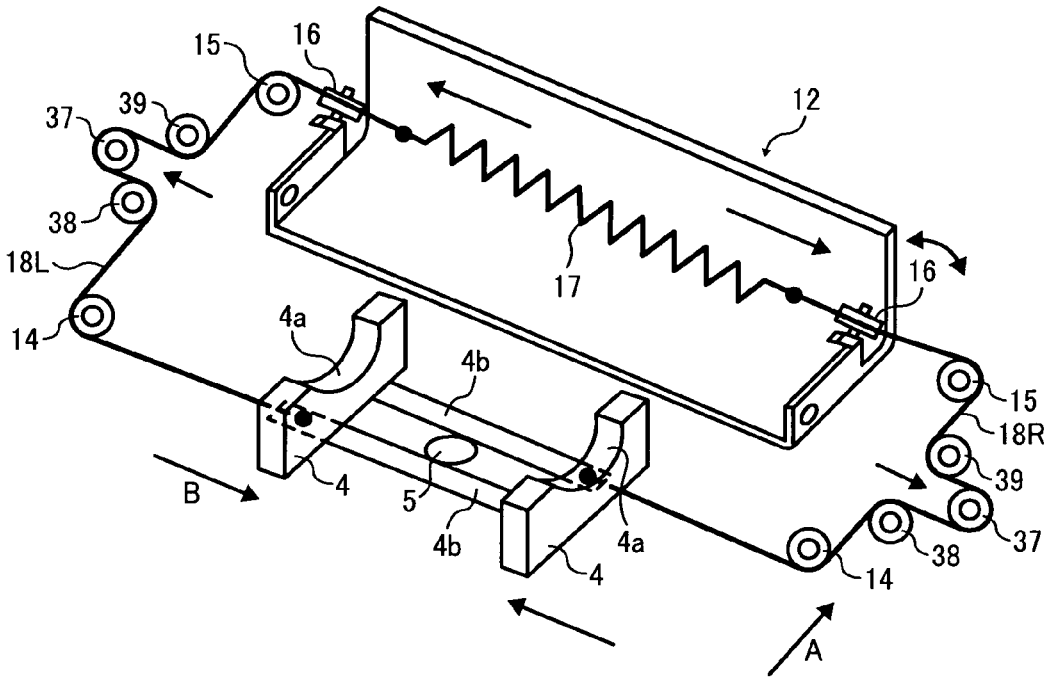
FIG. 13 is a schematic perspective view of a sheet conveyance unit according to another illustrative embodiment.
Figure 14:
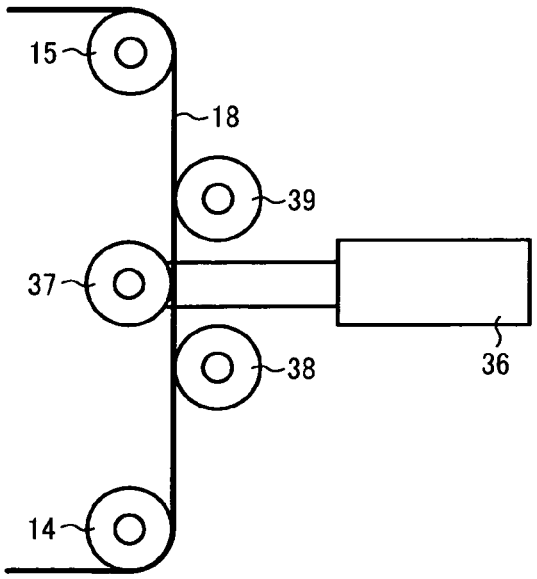
FIG. 14 is an enlarged plan view that illustrates a tension adjustment unit.
Figure 15:
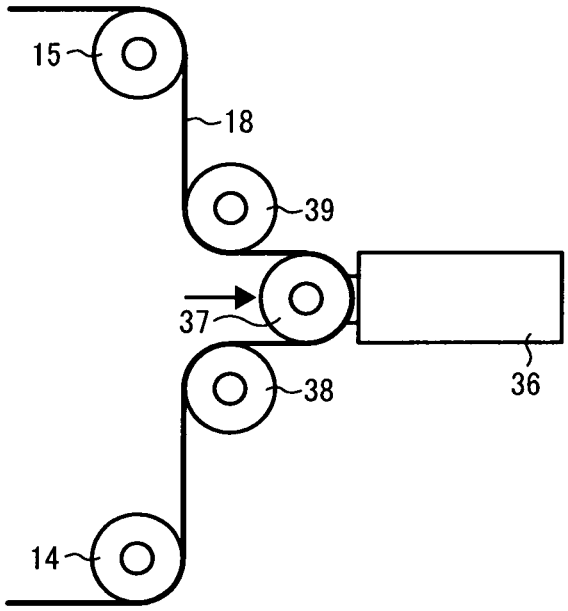
FIG. 15 is an enlarged plan view that illustrates the tension adjustment unit.

As shown in FIGS. 13 through 15, the tension adjustment unit 50 includes a solenoid 36, a pair of pulleys (second pulleys) 37, a pair of pulleys 38, and a pair of pulleys 39, together forming the second adjuster. Each pulley 37 is positioned between the pulley 14 and the pulley 15. Each pulley 37 can rotate and move inside and outside the loop formed by the first wires 18, driven by the solenoid 36, and thus can pull the first wire 18 outside. The pulleys 38 and pulleys 39 are provided on both sides of the respective pulleys 37 outside the loop formed by the first wires 18 so as to be driven by the first wires 18. The pulleys 37 are positioned to pull the first wires 18 a predetermined amount in a normal state and can pull and loosen the first wires 18.

With the above-described configuration, in the image forming apparatus according to the second embodiment, when the sheet S is set in the apparatus, skew and slippage of the sheet S can be detected and corrected automatically.

Figure 16:
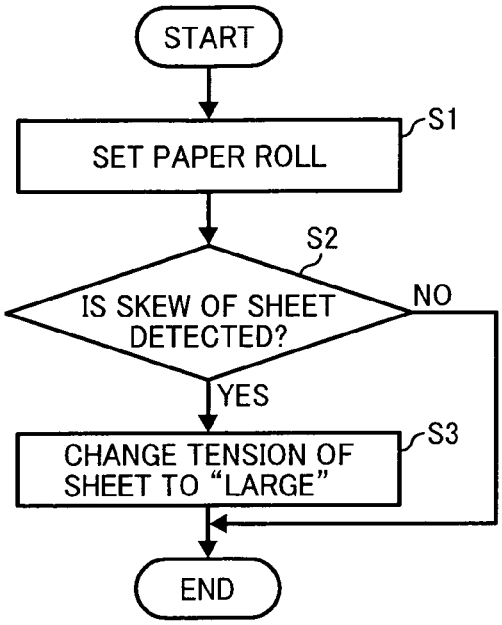
FIG. 16 is a flowchart of operation of the sheet conveyance unit according to an illustrative embodiment.

FIG. 16 is a flowchart of operation of the sheet conveyance unit 200A according to the second embodiment.

As shown in FIG. 16, at S1 the sheet S is set in the sheet conveyance unit 200A and its leading edge portion is conveyed to the carriage 2 (initial setting of the sheet S). At S2 the skew detector 30 detects whether or not the sheet S is skewed. If the sheet S is skewed (Yes at S2), at S3 the eighth pulleys 37 are moved outside the loop formed by the first wires 18 without changing the interval between the supporters 4, thereby pulling the first wires 18. Accordingly, the first tension spring 17 is extended, thereby increasing the force pushing the pressure member 12 down, exerted on the pressure member 12. Consequently, the tension of the sheet S increases, thus correcting the skew of the sheet S. When the skew of the sheet S is thus eliminated, the sheet S is conveyed, for example, to the printing start position so that printing can be executed, and setting of the sheet S is completed. When the skew of the sheet S is not detected (No at S2), the sheet S is conveyed so that printing can be executed, and setting of the sheet S is completed.

For example, although it is generally difficult to transport reliably smaller sheets, that is, sheets having a smaller width, among multiple sheet sizes that the sheet conveyance unit 200A accommodate, and such sheets can be skewed easily because the force to return the sheet is small when the sheet is skewed, the skew can be corrected as described above in the present embodiment.

Figure 17:
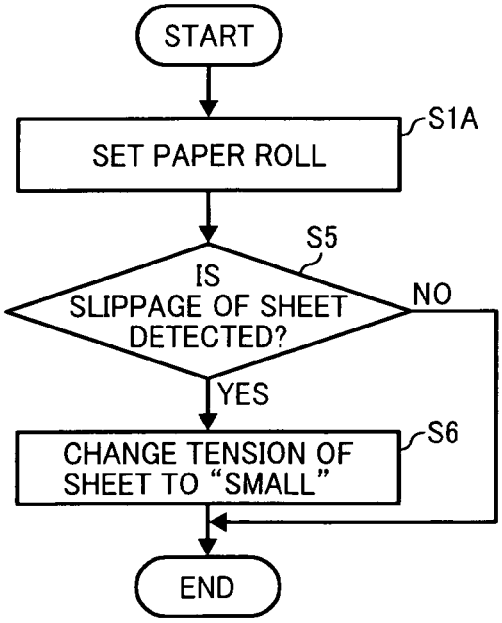
FIG. 17 is another flowchart of operation of the sheet conveyance unit.

FIG. 17 is another flowchart of operation of the sheet conveyance unit 200A according to the second embodiment.

As shown in FIG. 17, at S1A initial setting of the sheet S is started. At S5 the slippage detector detects whether or not slippage of the sheet S occurs. If the sheet S slips (Yes at S5), at S6 the pulleys 37 are moved inside the loop formed by the first wires 18 without changing the interval between the supporters 4, thereby loosening the first wires 18. Accordingly, the first tension spring 17 shrinks, thereby reducing the force pushing the pressure member 12 down, exerted on the pressure member 12. Consequently, the tension of the sheet S is reduced, and thus correcting the slippage of the sheet S. When the slippage of the sheet S is thus eliminated, the sheet S is conveyed, for example, to the printing start position, and setting of the sheet S is completed. When slippage of the sheet S is not detected (No at S5), the sheet S is conveyed so that printing can be executed, and setting of the sheet S is completed.

As described above, in the second embodiment, skew and slippage of the sheet S can be corrected in addition to the effect attained in the first embodiment, and thus enhancing reliability in conveyance of the sheet S.

The features of the above-described first and second embodiments can adapt to continuous conveyance of sheet as well as intermittent conveyance of rolled sheet.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus, comprising:

a carriage including an image forming unit; and a sheet conveyance unit for transporting a sheet unreeled from a roll, the sheet conveyance unit including:

a casing;

a roll holder to hold a roll of the sheet including a pair of supporters to support both sides of end portions of a shaft of the roll, the pair of supporters to move in an axial direction of the roll with a space provided between the supporters, the space of which can be varied;

a pair of first conveyance rollers to clamp the sheet unreeled from the roll therebetween and to transport the sheet;

a pair of second conveyance rollers disposed downstream from the pair of first conveyance rollers in a sheet conveyance direction and disposed upstream of the carriage, to clamp the sheet between the pair of first conveyance rollers and the second conveyance rollers so that the sheet can be transported from the pair of first conveyance rollers;

a tensioner to tension the sheet, disposed between the pair of first conveyance rollers and the pair of second conveyance rollers, the tensioner including a contact plate extending over an entire width of the sheet and having a first face to move and press a surface of the sheet with a plate surface of the contact plate, the contact plate pivotably supported on the casing of the sheet conveyance unit; and a tension adjustment unit to adjust the tension of the sheet by adjusting a force to press the contact plate against the sheet, the tension adjustment unit including a first adjuster connected to the supporters of the roll holder, to adjust the force to move and press the contact plate against the sheet according to the distance of the space provided between the pair of supporters of the roll holder in the axial direction of the roll.

2. The image forming apparatus according to claim 1, wherein the first adjuster of the tension adjustment unit reduces the tension of the sheet by reducing the force to press the contact plate as the interval between the supporters of the roll holder is reduced and increases the tension of the sheet by increasing the force to press the contact plate as the interval between the supporters of the roll holder is increased.

3. The image forming apparatus according to claim 2, wherein the first adjuster of the tension adjustment unit comprises:

a tension spring extending in a sheet width direction perpendicular to the sheet conveyance direction, to press a second face of the contact plate opposite the first face that contacts the sheet;

a pair of first pulleys provided on either side of the tension spring in the sheet width direction; and a pair of first wires respectively connected to both ends of the tension spring, wound around the pair of first pulleys, and connected to the supporters, wherein each of the first wires is connected to the end of the tension spring and the supporter on opposite sides.

4. The image forming apparatus according to claim 1, further comprising a first clamping force adjustment unit connected to the supporters of the roll holder and the pair of first conveyance rollers, to adjust a clamping force with which the pair of first conveyance rollers clamps the sheet therein in accordance with the interval between the supporters of the roll holder, wherein the first clamping force adjustment unit reduces the clamping force of the pair of first conveyance rollers as the interval between the supporters of the roll holder is reduced and increases the clamping force of the pair of first conveyance rollers as the interval between the supporters of the roll holder is increased.

5. The image forming apparatus according to claim 4, wherein the first clamping force adjustment unit comprises:

a pair of first elastic members respectively connected to both end portions of a shaft of one of the first conveyance rollers;

a pair of first pivotable arms respectively pressing against the both end portions of the shaft of the one the first conveyance rollers via the first elastic member; and a pair of second wires each connected to one of the pivotable arms and one of the supporters on the same side.

6. The image forming apparatus according to claim 1, further comprising a second clamping force adjustment unit connected to the supporters of the roll holder and the pair of second conveyance rollers, to adjust a clamping force with which the pair of second conveyance rollers clamps the sheet therein in accordance with the interval between the supporters of the roll holder.

7. The image forming apparatus according to claim 6, wherein the pair of second conveyance rollers is a pair of registration rollers to send out the sheet at a predetermined timing, and the second clamping force adjustment unit increases the clamping force of the pair of second conveyance rollers when the interval between the supporters of the roll holder is reduced and reduces the clamping force of the pair of second conveyance rollers when the interval between the supporters of the roll holder is increased.

8. The image forming apparatus according to claim 7, wherein the second clamping force adjustment unit comprises:

a pair of second pivotable arms each having a first end portion fixed to a bearing of a shaft of one of the second conveyance rollers;

a pair of second elastic members each connected between a second end portion of one of the second pivotable arms and the casing of the sheet conveyance unit;

a pair of third elastic members each having a first end connected to the second end portion of one of the second pivotable arms; and a pair of third wires each connected to a second end of one of the third elastic members and one of the supporters on opposite sides.

9. The image forming apparatus according to claim 1, wherein the tension adjustment unit further comprises a second adjuster to adjust the tension of the sheet set by the first adjuster, the second adjuster adjusting the tension of the sheet independently of the interval between the supporters of the roller holder.

10. The image forming apparatus according to claim 9, wherein the second adjuster of the tension adjustment unit comprises:

a pair of second pulleys around which first wires are wound, respectively; and a solenoid to move the pair of second pulleys outside and inside the first wires to cause a tension spring of the first adjuster to extend and to contract.

11. The image forming apparatus according to claim 9, further comprising a skew detector to detect skew of the sheet transported by the first conveyance rollers and the second conveyance rollers, wherein, when the skew detector detects that the sheet is skewed, the second adjuster of the tension adjustment unit increases the tension of the sheet by increasing the force to press the contact plate.

12. The image forming apparatus according to claim 11, wherein the skew detector comprises a photosensor disposed along a sheet conveyance path through which the sheet is transported, wherein a center portion of the photosensor in a sheet width direction is aligned with one lateral edge of the sheet in the sheet width direction.

13. The image forming apparatus according to claim 9, further comprising a slippage detector to detect slippage of the sheet transported by the first conveyance rollers and the second conveyance rollers, wherein, when the slippage detector detects slippage of the sheet, the second adjuster of the tension adjustment unit reduces the tension of the sheet by reducing the force to press the contact plate.

14. The image forming apparatus according to claim 13, further comprising a roller disposed facing one of the second conveyance rollers via the sheet, the roller driven by conveyance of the sheet, wherein the slippage detector comprises:

a first rotary encoder that includes a first slit disc provided at the shaft of one of the second conveyance rollers and a first transmission photosensor to detect a theoretical conveyance amount by which the sheet is transported theoretically by detecting a slit of the first slit disc; and a second rotary encoder that includes a second slit disc, provided at a shaft of the roller disposed facing the one of the second conveyance rollers, and a second transmission photosensor to detect an actual conveyance amount by which the sheet is actually transported by detecting the slit of the second slit disc, wherein the slippage detector compares the theoretical conveyance amount of the sheet per unit time detected by the first rotary encoder with the actual conveyance amount of the sheet per unit time detected by the second rotary encoder to detect slippage of the sheet.

15. The image forming apparatus according to claim 1, wherein the pair of racks includes a rack teeth facing each other.

16. The image forming apparatus according to claim 15, further comprising a rotatable pinion gear, wherein the teeth of the pair of racks engage with the rotatable pinion gear to adjust the interval between the supporters.

17. The image forming apparatus according to claim 1, wherein the pair of supporters includes a semicircular recess formed in an upper portion of each supporter to support the roll.

* * * * *